US011555398B2

(12) United States Patent
Stark et al.

(10) Patent No.: US 11,555,398 B2
(45) Date of Patent: Jan. 17, 2023

(54) DETERMINING PRESSURE MEASUREMENT LOCATIONS, FLUID TYPE, LOCATION OF FLUID CONTACTS, AND SAMPLING LOCATIONS IN ONE OR MORE RESERVOIR COMPARTMENTS OF A GEOLOGICAL FORMATION

(71) Applicant: Halliburton Energy Services, Inc., Houston, TX (US)

(72) Inventors: Daniel Joshua Stark, Houston, TX (US); Christopher Michael Jones, Katy, TX (US); Bin Dai, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 714 days.

(21) Appl. No.: 16/347,526

(22) PCT Filed: Apr. 12, 2018

(86) PCT No.: PCT/US2018/027320

§ 371 (c)(1),
(2) Date: May 3, 2019

(87) PCT Pub. No.: WO2019/199312

PCT Pub. Date: Oct. 17, 2019

(65) Prior Publication Data

US 2020/0149387 A1 May 14, 2020

(51) Int. Cl.

| | |
|---|---|
| ***E21B 47/06*** | (2012.01) |
| ***E21B 47/10*** | (2012.01) |
| ***E21B 49/08*** | (2006.01) |

(52) U.S. Cl.

CPC ..... *E21B 47/06* (2013.01); *E21B 47/10* (2013.01); *E21B 49/082* (2013.01); *E21B 49/088* (2013.01)

(58) Field of Classification Search

CPC ..... E12B 47/06; E12B 47/10; E12B 47/082; E12B 47/088

See application file for complete search history.

(56) References Cited

U.S. PATENT DOCUMENTS 4,943,918 A * 7/1990 Young ..... G01V 1/303 367/37
5,230,244 A * 7/1993 Gilbert ..... E21B 49/10 73/152.17

(Continued)

FOREIGN PATENT DOCUMENTS

WO 2000043812 7/2000

OTHER PUBLICATIONS

Zhou et al., Reservoir Fluid Evaluation from Real Time Pressure Gradient Analysis: Discussions on Principles, Workflow, and Applications, Oct. 20-22, 2008, 2008 SPE Asia Pacific Oil & Gas Conference and Exhibition, Perth, Australia, 13 pp. (Year: 2008).*

(Continued)

*Primary Examiner* — Toan M Le

(74) *Attorney, Agent, or Firm* — Delizio, Peacock, Lewin & Guerra

(57) ABSTRACT

A downhole tool is positioned in a borehole of a geological formation at a given depth. A formation property is determined at the given depth. The positioning and determining is repeated to form data points of a data set indicative of formation properties at various depths in the borehole. One or more outlier data points is removed from the data set based on first gradients to form an updated data set. One or more properties associated with a reservoir compartment are determined based on second respective gradients associated with the updated data set.

21 Claims, 10 Drawing Sheets

(56) References Cited

U.S. PATENT DOCUMENTS

| | | | | |
|---|---|---|---|---|
| 7,249,009 | B2 | 7/2007 | Ferworn et al. | |
| 8,124,931 | B2 * | 2/2012 | Andrews | G01V 8/02 250/301 |
| 8,918,288 | B2 | 12/2014 | Chok et al. | |
| 10,371,857 | B1 * | 8/2019 | Venter | G06K 9/00476 |
| 2012/0054184 | A1 | 3/2012 | Masud et al. | |
| 2013/0096835 | A1 | 4/2013 | Chok et al. | |
| 2015/0015250 | A1 * | 1/2015 | Gzara | G01N 24/08 324/303 |
| 2015/0025805 | A1 | 1/2015 | Hanak et al. | |
| 2015/0046092 | A1 | 2/2015 | Chok et al. | |
| 2016/0222741 | A1 * | 8/2016 | Lovorn | G05B 13/048 |
| 2017/0343693 | A1 | 11/2017 | Walker | |
| 2019/0383133 | A1 * | 12/2019 | Pollack | G01V 99/005 |
| 2020/0264116 | A1 * | 8/2020 | Gawankar | G01N 24/081 |

OTHER PUBLICATIONS

PCT Application Serial No. PCT/US2018/027320, International Search Report, dated Jan. 18, 2019, 3 pages.

PCT Application Serial No. PCT/US2018/027320, International Written Opinion, dated Jan. 18, 2019, 9 pages.

Collins, et al., "An Integrated Approach to Reservoir Connectivity and Fluid Contact Estimates by Applying Statistical Analysis Methods to Pressure Gradients", Society of Petrophysicists and Well-Log Analysts, SPWLA 48th Annual Logging Symposium, Austin, Texas, Jun. 2007, 16 pages.

Stewart, et al., "The Interpretation of Vertical Pressure Gradients Measured at Observation Wells in Developed Reservoirs", Society of Petroleum Engineers, SPE Annual Technical Conference and Exhibition, New Orleans, Louisiana, Sep. 1982, 12 pages.

* cited by examiner

DETERMINING PRESSURE MEASUREMENT LOCATIONS, FLUID TYPE, LOCATION OF FLUID CONTACTS, AND SAMPLING LOCATIONS IN ONE OR MORE RESERVOIR COMPARTMENTS OF A GEOLOGICAL FORMATION

TECHNICAL FIELD

This disclosure generally relates to the field of formation evaluation, and more particularly to determining reservoir properties, including reservoir fluid properties including fluid type and location of fluid contacts in one or more reservoir compartments of a geological formation.

BACKGROUND ART

A geological formation typically has one or more reservoir compartments containing one or more fluids such as oil, gas, and/or water. A reservoir compartment is typically an area of the geological formation bounded by an impermeable rock. In the case that a reservoir compartment has a plurality of fluids, the plurality of fluids is organized in layers such that a fluid with greatest density such as water is at a bottom of a reservoir compartment and a fluid with less density such as oil or gas is at a top of the reservoir compartment.

Conventional log measurements such as resistivity, gamma, neutron, nuclear magnetic resonance and/or acoustic are used to identify a type of fluid in the reservoir compartment. In the case that the reservoir compartment contains more than one fluid, the conventional log measurements are also used to identify fluid contacts. The fluid contacts characterize the depth at which fluid transitions from one type to another in a reservoir compartment, such as from oil to gas, oil to water, water to gas, etc. A disadvantage with the conventional log measurements is that inferences need to be made as to the fluid type and where the fluid contacts are located. Instead of conventional log measurements, pressure measurements can be used to identify the type of fluid and location of fluid contacts in the reservoir compartment. Pressure measurements are more conclusive indicators of fluid type and location of fluid contacts compared to conventional log measurements.

BRIEF DESCRIPTION OF THE DRAWINGS

Embodiments of the disclosure may be better understood by referencing the accompanying drawings.

DESCRIPTION OF EMBODIMENTS

Figure 1:
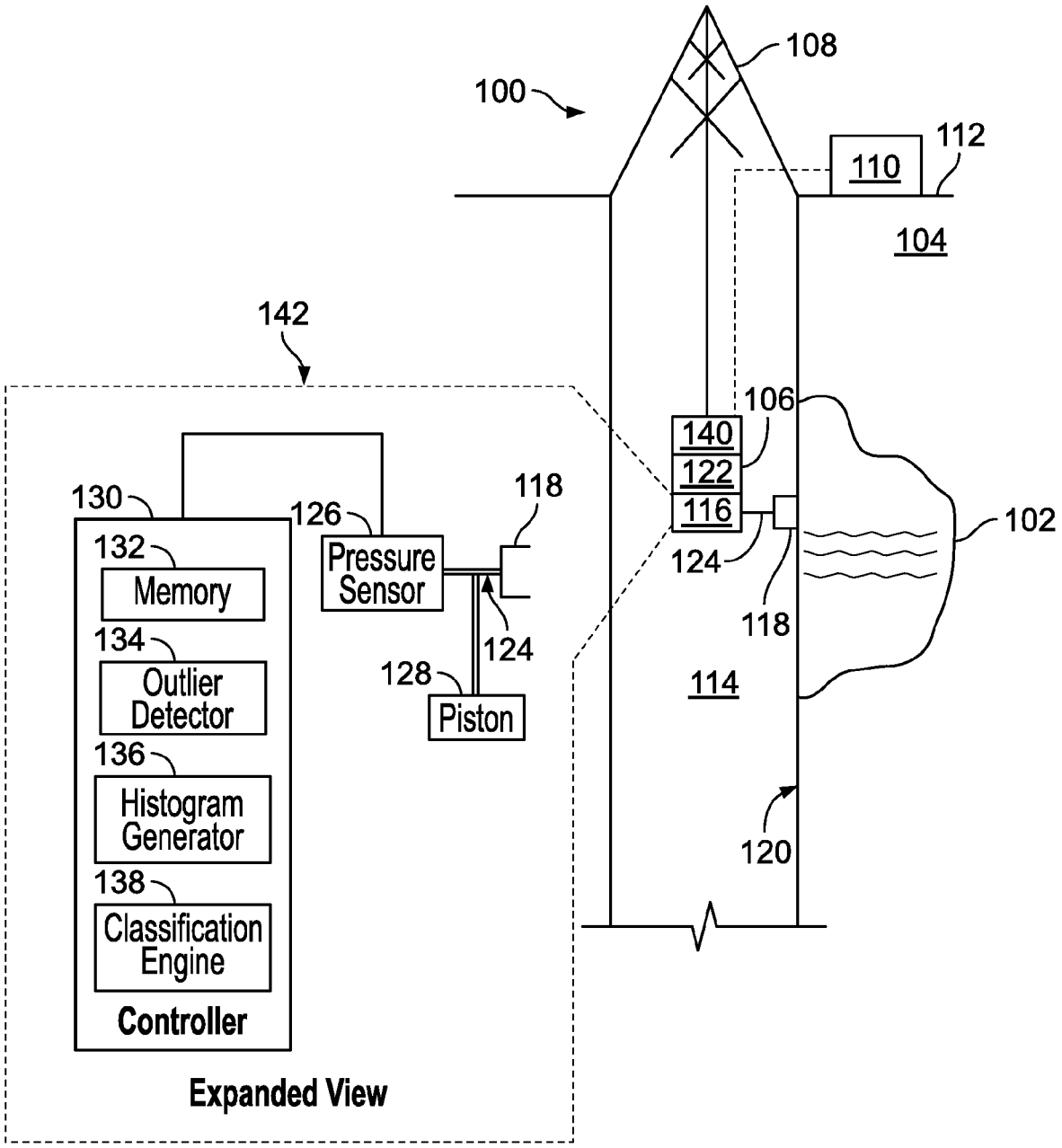
FIG. 1 shows a system for determining fluid type and location of fluid contacts in one or more reservoir compartments of a geological formation using pressure gradients.

The description that follows includes example systems, methods, techniques, and program flows associated with embodiments of the disclosure. However, it is understood that this disclosure may be practiced without these specific details. For instance, this disclosure refers to using pressure gradients to determine a fluid type and location of fluid contacts in one or more reservoir compartments of a geological formation in illustrative examples. The fluid type and/or fluid contacts are used to make decisions on sampling of fluid for purposes of hydrocarbon extraction. In some examples, formation properties in addition to individual pressure measurements or pressure gradients may be used to make these decisions. In other examples, the embodiments of this disclosure can also be applied in contexts other than hydrocarbon extraction. Well-known instruction instances, protocols, structures and techniques are not shown in detail in order to not obfuscate the description.

Overview

Pressure measurements taken downhole in a geological formation can be used to determine fluid type and location of fluid contacts in a reservoir compartment of the geological formation. However, sufficient density of pressure measurements with sufficient quality is required to make a conclusive determination.

Embodiments disclosed herein are directed to an improved method, system, and apparatus for determining the fluid type based on the pressure measurements and, in the case that a reservoir compartment includes a plurality of fluids, fluid contacts between fluids based on the pressure measurements.

A determination of the fluid type and/or fluid contacts in a reservoir compartment begins with taking pressure measurements in the formation over a plurality of depths to define a data set of data points such as pressure-depth data points. Some of the pressure measurements may be of low quality (e.g., erroneous) while other pressure measurements may be high quality (e.g., accurate). The low quality pressure measurements (i.e., outlier data) are removed from the data set such that high quality pressure measurements (i.e., inlier data) indicative of a baseline gradient of pressure in the geological formation remain in the data set. The removal may take many forms, including calculating pressure gradients among various combinations of pressure-depth data points and filtering out an erroneous pressure measurement if an associated pressure gradient lies outside a specified range.

In some examples, a pressure measurement may be assigned an index related to a degree of quality associated with the pressure measurement to facilitate taking further pressure measurements. Low quality pressure measurements may be assigned a low index and high quality (e.g., accurate) pressure measurements may be assigned a high index (or vice versa). The index may be assigned in a variety of ways, including based on a distance of the pressure measurement to the baseline gradient of pressure or based on a nature of the pressure test measurement itself, or combination therein. Conventional log data may also be combined with the assigned quality index, and used to identify depths where pressure measurements are of high quality and performing additional pressure measurements at those depths to further define the baseline gradient of pressure. This determination may be made prior to the pressure logging activity of the well under test (by corollary well or wells), during pressure logging of the current well, or combination thereof. Further, a baseline gradient of pressure for a given reservoir section may be used to determine spacing of desired pressure measurements or density with respect to depth for the given reservoir section or another reservoir section. For example, if the given reservoir section has a large baseline gradient (e.g., compared to some reference), then a higher density of pressure measurements may be taken in a depth range while if the given reservoir section has a small baseline gradient (e.g., compared to some reference), then a lower density of pressure measurements may be taken in a depth range.

Lines are fit to the inlier data indicative of the baseline gradient. The lines may be best fit lines to various combinations of two or more pressure-depth data points in a depth window and a histogram is generated based on slopes corresponding to each of the best fit lines. The slope is indicative of a linear pressure gradient. Other functions may be used to describe the pressure gradient such as modified linear, polynomial, or exponential functions. In these examples, the pressure gradient may be nonlinear gradients associated with fluid columns that exhibit effects of compositional grading, capillary pressure, compressibility, or other secondary phenomena to constant density.

This process is repeated for different depth windows to form a plurality of histograms. The histograms are then plotted to form a histogram map of pressure gradients. Each of the best fit lines may also have an intercept or offset with respect to fixed datum such as but not limited to a surface or depth mark. A similar process is also followed to form a histogram map of intercepts corresponding to each of the best fit lines.

One or more clusters are identified based on the histogram maps, and a mean and/or standard deviation of the pressure gradients associated with each of the clusters is calculated. The mean and/or standard deviation of the pressure gradients is indicative of the fluid type associated with each of the cluster. Fluid contacts are indicated by a position (e.g., depth) of one cluster with respect to another. The clusters are also analyzed to determine whether they are associated with fluid in a same or different reservoir compartment. To facilitate this determination, a mean of the intercepts associated with each cluster is calculated. If the mean of the pressures gradients and/or a mean of the intercepts associated with adjacent clusters exceed a threshold level, then an impermeable boundary such as rock may separate the clusters and the fluid associated with each cluster may be in different reservoir compartments. As another example, if the clusters indicate a certain grading as a function of depth which is physically unlikely without an impermeable boundary separating a fluid (e.g., water closer to the surface than oil indicates that an impermeable boundary separates the oil and water), then the fluid associated with each cluster may be in different reservoir compartments.

The fluid location with respect reservoir depth or other reservoir property may be used to locate a position from which to withdraw a fluid sample from the reservoir section. The fluid of a given type may be sampled to determine whether to and how to extract the fluid from a reservoir compartment as part of hydrocarbon extraction. In some cases, the baseline gradient and/or pressure gradients associated with the clusters may also be used to determine whether to and how to extract fluid from a reservoir compartment as a part of hydrocarbon extraction. These same pressure gradients may also be used to determine location of disposal wells and other petroleum production activities.

Example Illustrations

Illustrative embodiments and related methodologies of the present disclosure are described below in reference to the examples shown in FIGS. 1-9 as they might be employed, for example, in the context of using pressure gradients to determine a fluid type and location of fluid contacts in reservoir compartments of a geological formation. Other features and advantages of the disclosed embodiments will be or will become apparent to one of ordinary skill in the art upon examination of the following figures and detailed description. It is intended that all such additional features and advantages be included within the scope of the disclosed embodiments. Further, the illustrated figures are only exemplary and are not intended to assert or imply any limitation with regard to the environment, architecture, design, or process in which different embodiments may be implemented. While these examples may be described in the context of determining formation properties in a downhole environment, it should be appreciated that the generation is not intended to be limited thereto and that these techniques may be applied in other contexts as well.

FIG. 1 shows a system 100 for determining fluid type and location of fluid contacts in a reservoir compartment 102 of a geological formation 104. The reservoir compartments 102 is typically a pocket of one or more fluids in the geological formation 104 such as oil, gas, and/or water. The fluid type and location of fluid contacts is determined using pressure gradients in accordance with embodiments described herein.

The system 100 includes a downhole tool 106, conveyance apparatus 108, and surface equipment 110. The downhole tool 106 may perform pressure measurements in the geological formation 104. The downhole tool 106 can be any tool used for wireline formation testing, production logging, logging while drilling/measurement while drilling (LWD/MWD), or other operations. The tool 106 may be conveyed downhole by the conveyance apparatus 108 which can include a drill string, a tubular, a cable, a wireline, or other component at a surface 112 of the geological formation 104 for deploying the downhole tool 106 in a borehole 114. The downhole tool 106 can be part of an early evaluation system, e.g., disposed on a drill collar of a bottom hole assembly having a drill bit and other necessary components.

The downhole tool 106 may have a probe 116 for obtaining pressure measurements at various depths in the borehole 114 to determine formation pressures at the various depths. The probe 116 may include but is not limited to a packer, unidirectional probe, multidirectional probe, or series of probes at one or more longitudinal positions or radial positions within the downhole tool 106. To facilitate the pressure measurements, the downhole tool 106 is disposed at a desired location in the borehole 114. The downhole tool 106 can have a snorkel 118 that extends from the downhole tool 106 and engages an inner wall 120 of the borehole 114 to establish fluid communication with the geological formation 104. The snorkel 118 then seals with the inner wall 120 to establish fluid communication. The snorkel 118 may include but is not limited to a unidirectional snorkel, multidirectional snorkel, or series of snorkels at one or more longitudinal positions or radial positions within the downhole tool 106. It is noted that herein either a probe or snorkel may be used interchangeably or in combination to establish hydraulic communication of the downhole testing tool 116 with the geological formation 104 and further that in some contexts the snorkel 118 is a type of probe.

Structure 142 shows details of the apparatus associated with the probe 116 and snorkel 118. A pressure sensor 126 measures hydrostatic pressure of the fluid in the borehole 114. To do this, a pump 122 lowers pressure at the snorkel 118 below the pressure of the fluid in the borehole to below a formation pressure via a flow line 124 which fluidly connects the snorkel 118 to the pressure sensor 126. At this point, fluid is drawn into the probe 116 via the flow line 124 by retracting a piston 128. This creates a pressure drop in the flow line 124 below the formation pressure such that fluid from the formation 104 enters the probe 116. An amount of fluid that enters the probe may typically be 5-10 ccs of fluid but as much as 50 ccs or more of fluid. Given a sufficient amount of time, the pressure builds up in the flow line 124 until the flow line's pressure is the same as the formation pressure. The final build-up pressure measured by the pressure sensor 126 is referred to as the "sand face" or "pore" pressure and is assumed to approximate the formation pressure. Eventually, the snorkel 118 can be disengaged, and the downhole tool 106 can be positioned at a different depth to repeat the test cycle.

As the pressure testing is performed, the pressure measurements may be combined with depth data obtained by a depth sensor also associated with the downhole tool 106. Together the pressure and depth data form a pressure-depth data point (also referred to herein as data point). A plurality of data points may be then analyzed to determine a fluid type of the fluid in the formation 104 and/or fluid contacts in one or more reservoir compartments 102. To facilitate this analysis, the probe 116 may have a controller 130. The controller 130 may store the data points in memory 132. Additionally, the controller 130 may have various logic including an outlier detector 134, histogram generator 136, and a classification engine 138. The outlier detector 134 may remove those data points with erroneous pressure measurements referred to as outliers from the pressure measurements. For example, the snorkel 118 may often not make proper contact with the inner wall 120 of the borehole 114 which results in erroneously high pressure measurements which are filtered out by the outlier detector 134. The histogram generator 136 may then determine pressure gradients associated with remaining data points which are then organized into a histogram map. The histogram map may indicate a count of pressure gradients which are clustered by the classification engine 138. The clustering may allow the classification engine 138 to identify one or more of a fluid type and/or fluid contacts in the one or more reservoir compartments 102 of the formation 104. In this regard, the controller 130 is able to identify the type of fluid and/or fluid contacts in the one or more reservoir compartments 102 based on the pressure gradients.

The surface equipment 110 may receive results of the analysis of the pressure measurements via a wired or wireless connection with the downhole tool 106. In some cases, the downhole tool 106 may communicate the pressure-depth data points to the surface equipment 110. The surface equipment 110 can include a general-purpose computer and software for analyzing then pressure measurements associated with the data points from the downhole tool 106 instead of or in addition to the downhole tool 106.

The downhole tool 106 may use the determination of the fluid type and location of fluid contacts to sample fluid at a particular depth where the fluid is a particular type. The downhole tool 106 may be positioned at a depth where the fluid of the particular type is located. The fluid may be sampled by the probe 116 in a manner similar to that described above but additionally include a measurement device such as a spectrometer, a thermal conductivity analyzer, a resistometer, or the like for determining physical and chemical properties of the fluid that is sampled. Additionally, or alternatively, the fluid may be directed to a sample carrier section 140 where samples can be retained for additional analysis at the surface 112. The sample may be used to make decisions about whether to further drill in the formation 104 to extract the fluid and/or define a direction in which to drill in the formation 104.

Figure 2:
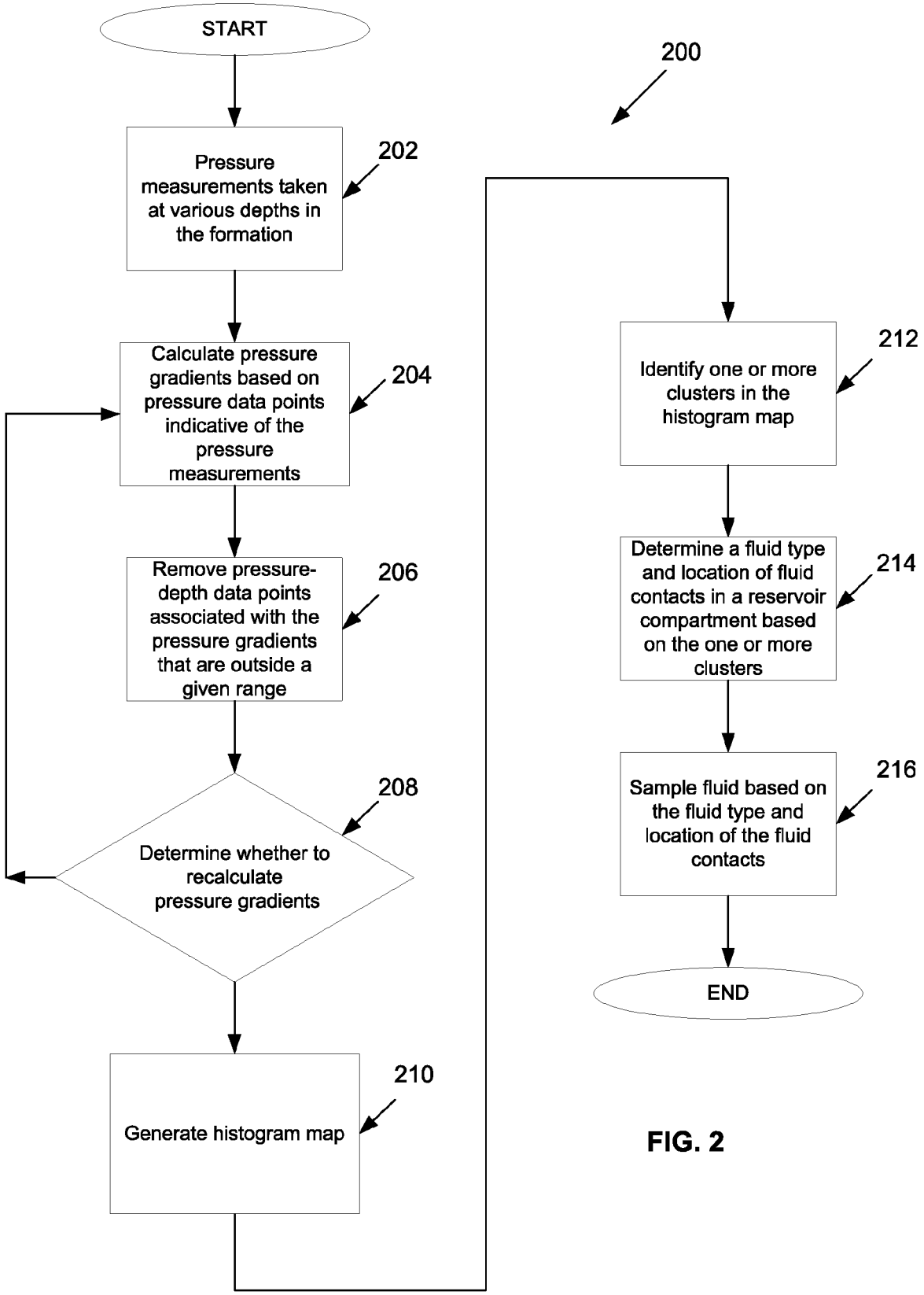
FIG. 2 is a flow chart of functions associated with determining fluid type and location of fluid contacts in the one or more reservoir compartments of the geological formation using pressure gradients.

FIG. 2 is a flow chart 200 of functions associated with determining the fluid type and location of fluid contacts in one or more reservoir compartments of a geological formation in accordance with the system 100. Briefly, at 202, pressure measurements are taken at various depths in the formation using the downhole tool to form a data set of pressure-depth data points. At 204, pressure gradients are calculated based on pressure-depth data points indicative of the pressure measurements. At 206, the pressure-depth data points associated with the pressure gradients that are outside a given range are removed from the data set. At 208, a determination is made whether to recalculate pressure gradients for the pressure-depth data points which were not removed. If the pressure gradients are recalculated processing returns to 204. If the pressure gradients are not recalculated, then at 210, a histogram map is generated based on the pressure-depth data points which were not removed. At 212, one or more clusters are identified in the histogram map. At 214, a fluid type and location of fluid contacts are determined based on the one or more clusters. At 216, fluid is sampled based on the determination of the fluid type and location of the fluid contacts.

Referring back, at 202, pressure measurements are taken at various depths in the formation using the downhole tool to form a data set of pressure-depth data points. A pressure measurement may be taken via the downhole tool positioned in the borehole at given depth to form a pressure-depth data point. The downhole tool may be moved to the given depth so that the probe can extract fluid from the formation via snorkel. The probe may then measure the pressure of the fluid at the given depth. This process may be repeated for multiple depths in the borehole to form a plurality of pressure-depth data points.

Figure 3:
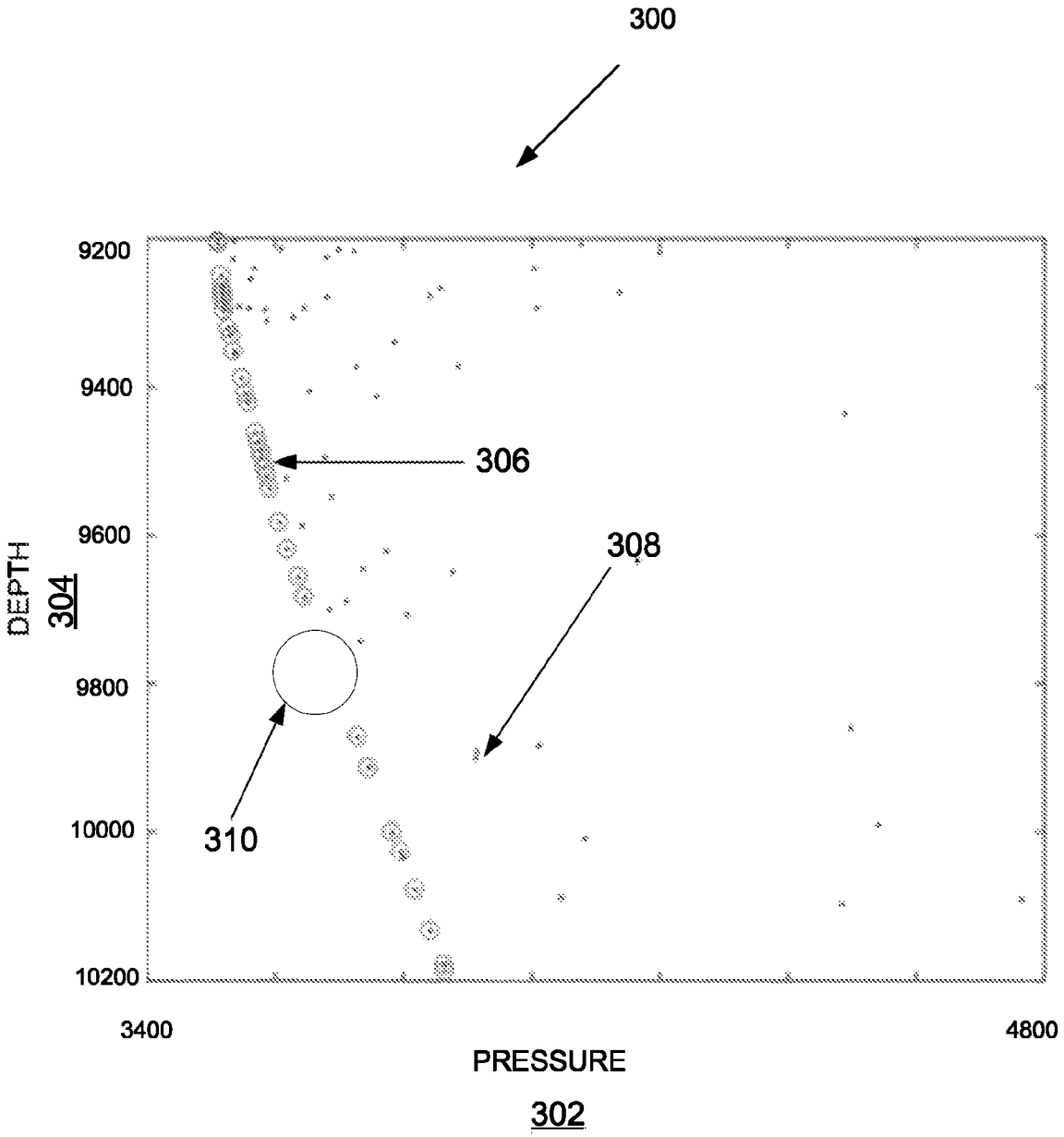
FIG. 3 depicts pressure measurements taken at different depths in the well.

FIG. 3 depicts a plot 300 of the pressure measurements taken at different depths in the well. A horizontal axis 302 may indicate a pressure and a vertical axis 304 may indicate a depth at which the pressure is measured. A pressure measurement may indicate the pressure in the formation at a given depth.

Certain pressure measurements at certain depths may be low quality measurements (e.g., erroneous due to errors in the measurement process), including the snorkel not obtaining a proper suction with the inner wall of the borehole during the pressure measurement. The low quality pressure measurements (i.e., outlier data) are removed from the data set such that inlier data indicative of a baseline gradient of pressure in the geological formation remains. It should be noted that baseline refers to an actual gradient trend of the subsurface formation in the absence of the low quality pressure measurements and does not refer to any specific trend location within a dataset.

Low quality pressure measurements may be identified in a variety of ways. For example, at 204, pressure gradients are calculated based on the pressure-depth data points to filter out the low quality pressure measurements. A slope is calculated between each possible combination of two or more pressure-depth data points in the data set. To illustrate, a slope may be calculated as $(p_1-p_2)/(d_1-d_2)$ where the pressure data points are $(p_1, d_1)$ and $(p_2, d_2)$ where $p_1$ is a pressure measurement and $d_i$ is a depth at which the pressure measurement is made. The slope is indicative of the pressure gradient (i.e., rate of change of pressure with respect to depth) between the combination of the pressure-depth data points. In some cases, the pressure gradient may be adjusted, e.g., for compressibility of the fluid, leading to a linear term being added to the pressure gradient. Robust nonlinear regression methods, such as robust least squares, can be used to estimate this linear term.

At 206, pressure-depth data points associated with the pressure gradients that are outside a given range are removed from the data set. For example, the pressure gradient for a pressure-depth data point pair is compared to an extrema range indicative of minimum and maximum pressure gradients associated with various fluids that can be found in the formation. To illustrate, the range in pressure gradients can be 0.08 PSI/ft to 0.09 PSI/ft (for gas) and 0.45 PSI/ft to 0.5 PSI/ft (for brine). If the slope is outside of these ranges, then the pressure gradient can be labeled as unphysical since the pressure gradient is unlikely to exist in the formation. If the slope lies within these ranges, then the pressure gradient can be labeled as physical since the pressure gradient is likely to exist in the formation. For a pressure gradient labeled as unphysical, one or both of the pressure-depth data points associated with the pressure gradient is removed. In some examples, the pressure-depth data point with the highest pressure is removed from the data set; in other examples, the data point with the lowest pressure is removed. In some cases, some pressure-depth data point in between the highest and lowest pressure is removed. This process of removing pressure-depth data points is repeated for each of the pressure gradients labeled as unphysical.

At 208, a determination is made whether to recalculate pressure gradients for the remaining pressure-depth data points in the data set which were not removed. For example, pressure gradients may be recalculated at 204 if more than a threshold number of pressure-depth data points were removed. Otherwise, processing will continue to 210. Additionally, or alternatively, the pressure gradients may be recalculated a predefined number of times for the data set. After the predefined number of times, processing will continue to 210. If the determination is to recalculate the pressure gradients, then the recalculated pressure gradients are categorized as physical or unphysical, and one or both of the pressure-depth data points associated with the pressure gradient which is categorized as unphysical is removed at steps 204-206. If pressure gradients for the remaining data points are not to be recalculated, then the pressure-depth data points in the data set are considered accurate, i.e., inlier data, and processing continues to step 210. The pressure-depth data points in the data set which were not removed are identified with circles 306 and referred to as inlier data and indicative of a baseline gradient of the pressure as a function of depth in the formation. The remaining pressure-depth data points are removed from the data set and referred to as outlier data 308.

Outlier data can be removed in other ways as well. For example, statistical means such as robust linear model estimation can be used to identify linear regressions that best fit data. A random sample consensus (RANSAC) regressor, for example, is well known to remove outlier data from data sets while leaving a small set of inliers. Other methods include Maximum Likelihood Estimate SAmple Consensus (MLESAC), Maximum A Posterior SAmple Consensus (MAPSAC). Other families of regressors include Ridge regression, Bayesian regression, Lasso and Elastic Net estimators with Least Angle Regression and coordinate descent, and Stochastic Gradient Descent, among others. The baseline gradient of pressure may be determined based on pattern recognition, image analysis, and/or machine learning processes of the pressure-depth data points to separate the outlier data from the inlier data. In yet another example, a minimum pressure for a range of depths may be taken as the inliers. Analysis shows that errors during pressure measurements are generally towards high pressure. For example, a data point with minimum pressure every 20 ft of depth would be taken as the inlier. The inliers determined in this manner as a function of depth would be indicative of the baseline gradient of pressure.

In some examples, a pressure measurement may be assigned an index related to a degree of quality associated with the pressure measurement to facilitate taking additional pressure measurements. Low quality pressure measurements may be assigned a low index and high quality (e.g., accurate) pressure measurements may be assigned a high index (or vice versa). The index may be assigned in a variety of ways.

For example, the quality index may be based on a distance between a pressure-depth data point (i.e., pressure measurement) and the baseline gradient of pressure. The quality index may be inversely related to the distance. As another example, the quality index may be related to a repeatability of the pressure measurement. If the same pressure measurement at the same depth is performed with the same result, then the quality index may indicate a high quality pressure measurement. If the same pressure measurement at the same depth is performed with different results, then the quality index may indicate a low quality pressure measurement. As yet another example, the quality index may be stability of the pressure measurement such as a standard deviation of the pressure measurement. If the same pressure measurement at the same depth is performed with results within a given standard deviation, then the quality index may indicate a high quality pressure measurement. If the same pressure measurement at the same depth is performed with results outside the given standard deviation, then the quality index may indicate a low quality pressure measurement. As an example, the quality index may be based on a mobility (e.g., permeability, viscosity etc.) of the fluid flow in the formation. Certain fluid mobility may lend to high quality indices while other fluid types may lend to low quality indices. The quality index may be defined by other parameters as well.

Additional pressure measurements may be performed at those depths associated with high quality indices. In some cases, the conventional log data may be combined with the assigned quality index to identify depths where pressure measurements are of high quality. This determination may be made prior to the pressure logging activity of the well under test (by corollary well or wells), during pressure logging of the current well, or combination thereof. Further, a baseline gradient of pressure for a given reservoir section may be used to determine spacing of desired pressure measurements or density with respect to depth for the given reservoir section or another reservoir section. For example, if the given reservoir section has a large pressure gradient, then a higher density of pressure measurements may be taken in a depth range while if the given reservoir section has a smaller pressure gradient, then a lower density of pressure measurements may be taken in a depth range.

In some examples, the pressure measurements for some depths may be sparse due to the number of pressure measurements that are performed for those depths. For example, the pressure-depth data at 310 with depth from 9750 ft to 9850 ft is sparse. In this case, additional data can be interpolated between the pressure-depth data points present in the data set to add more values for generating a more robust baseline gradient. Alternatively, the downhole tool can be used to collect additional pressure-depth data points for those depths. The downhole tool may be repositioned at the depths where pressure measurements are sparse and pressure measurement taken at those depths. In some examples, the depth at which the pressure measurements is taken may not be exactly the same as the depth where the pressure-depth data is sparse but at a different depth in case a surface of the wall of the formation at the depth where the pressure-depth is sparse does not lend to pressure measurements. The pressure measurements may be taken at depths where pressure measurements with sufficient quality index were previously taken and/or depths where conventional log measurement data is correlated pressure measurements with sufficient quality index. Alternatively, the pressure measurements may not be taken at depths where pressure measurements with insufficient quality index were previously taken and/or based on conventional log measurement data that is correlated with pressure measurements with insufficient quality index.

The probe 116 or snorkel 118 (or multiple probes or snorkels) may be arranged to obtain sufficient density of sufficient quality pressure measurements at a depth in a time or cost efficient manner. In some cases, the quality of pressure measurements may vary because the snorkel of the downhole tool might not be able to obtain a proper seal with the wall of the formation at a given depth to form a suction to measure pressure. The seal may be better at a different depth so the pressure is measured at the different depth. The different depth may be correlated or classified with a quality index. The depths within a desired depth window may be chosen according to the highest probability of high quality index above a desired threshold, or a composite quality index of pressure measurements performed by multiple probes or snorkels that is above a predefined threshold. In some embodiments, the threshold may be dynamically defined by an equation or set of conditions. Such an example may include but not be limited to a maximum average probability for a quality index within a smaller window of the desired depth window, or composite quality index (e.g., average of indices) associated with pressure measurements taken by multiple snorkels or probes.

At 210, a histogram map is generated based on the pressure-depth data points in the data set that define the baseline gradient of pressure (i.e., inlier data). The histogram map may comprise a plurality of histograms where each histogram describes a count of pressure gradients associated with a given depth.

A histogram is constructed in an iterative manner by iteratively defining a depth window. The depth window may be a range of depths over which the histogram is computed. A pressure depth data point may take the form of a pair of values ($p_i$, $d_i$) where $p_i$ is a pressure value and $d_i$ is a corresponding depth value for the pressure value. A subset of pressure-depth data points of the data set is taken consisting of values ($p_i$, $d_i$), ($p_{i+1}$, $d_{i+1}$), . . . , ($p_j$, $d_j$), where i and j are integers and the depth di to dj spans the range of depths constrained by the depth window. The depth window may be chosen to include enough points to mitigate sample sparsity but to contain few enough points that the chance that more than two fluids are contained with this data subset is extremely low due to the nature of compositional grading of fluid that might be possible in a reservoir compartment. The depth window may be defined in many ways. For example, the depth window may be defined by formation properties indicated by formation logs such as resistivity logs. The depth window may be those range of depths with homogenous formation properties that indicate fluid of one type.

As an example, a depth window may be 50 ft and five pressure-depth data points spread over 50 ft is chosen as the subset within the depth window. A line is calculated for every potential combination of pressure-depth data points with two or more pressure-depth data points, e.g. {i, i+2, i+3}, {i+1, i+4}, {i, i+1, i+2, i+3, i+4}. For example, the line may best fit a given combination of the pressure-depth data points (e.g., based on a linear or non-linear least squares analysis). A slope (i.e., pressure gradient as between the combination of the pressure-depth data points) and intercept are tabulated for each line associated with each combination. In some cases, the intercept (also referred to as an offset) is with respect to fixed datum such as but not limited to a surface or depth mark. Separate pressure gradient and intercept histograms are then generated based on the pressure gradients and intercepts associated with a depth window. The pressure gradients and intercept histograms may be associated with a depth within the depth window, such as a midpoint of the depth window. In some examples, the slope and/or intercept associated with the line may be duplicated one or more times depending on a number of points used to generate the line. For instance, the number of times the slope is tabulated in the histogram is equal to the number of elements in the permutation less one, e.g. there is only one slope entry corresponding to pressure-depth data points {i+1, i+4}, but four copies of the slope corresponding to pressure-depth data points {i, i+1, i+2, i+3, i+4} because with additional points, the reliability of the slope and intercept is greater thereby increasing the count of the slopes and/or intercepts in the histogram. As another example, a number of copies of the slope in the histogram calculation may be equal to the index separation between the pressure-depth data points (e.g.: {i, i+1} would have one copy while {i, i+2} would have two copies). Other variations are also possible.

This process is repeated for a plurality of overlapping or non-overlapping depth windows to form a plurality of histograms. An example of depth windows that overlap may be windows which span 6000 to 6050 ft, then 6001 to 6051 ft etc. while an example of depth windows that does not overlap may be windows which span 6000 to 6050 ft and then 6050 to 6100 ft.

Figure 4A:
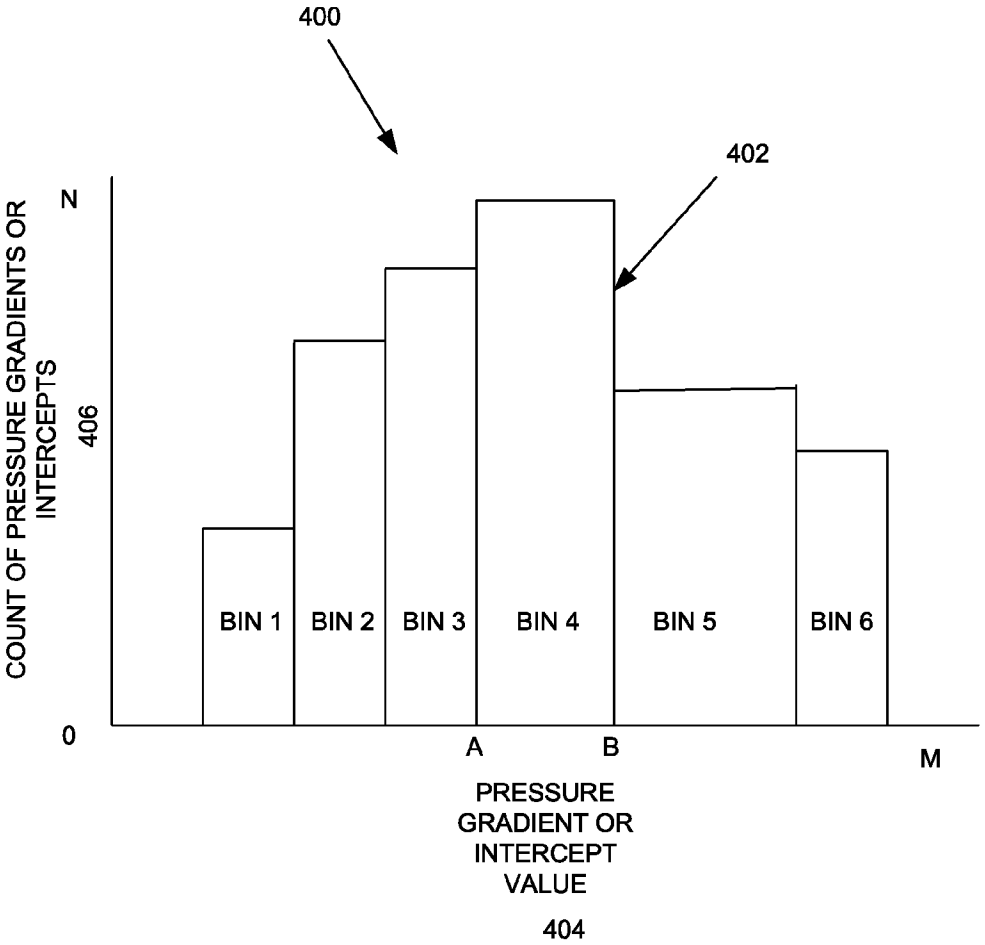
FIGS. 4A and 4B illustrate an example of a histogram and histogram map respectively.

FIG. 4A is an example of a histogram 400. The counts of pressure gradients or intercepts in the depth window may be binned into one of a plurality of non-overlapping bins 402 where each bin span a given range of pressure gradients (e.g. A to B) on an axis 404 within a range of 0 to M. In the case of a histogram based on slopes, a number of pressure gradients which fall within the range of a bin in the depth window may be assigned to the bin (i.e., count 406 within a range of 0 to N). In the case of a histogram based on intercepts, a number of intercepts which fall within the range of a bin may be assigned to the bin (i.e., count 406 within a range of 0 to N). In some cases, the bins may be iteratively chosen. A large bin may initially be chosen and a histogram 400 generated. If the histogram 400 is not Gaussian in shape (or some other predefined shape), a size of one or more of the bins may be increased and/or reduced and this process repeated until the histogram 400 is the Gaussian shape. In this regard, the bin size may be adjusted until the histogram 400 is Gaussian in shape.

The plurality of histograms associated with different depth windows is then plotted together to form a histogram map. Each histogram may be plotted at a given depth which corresponds to the depth window used to generate the histogram such as a midpoint of the depth window. To illustrate, a histogram generated for the depth window from 6000 ft to 6050 ft would be plotted at a depth of 6025 ft on the histogram map while a histogram generated for the depth window from 6050 ft to 6100 ft would be plotted at a depth of 6075 ft.

Figure 4B:
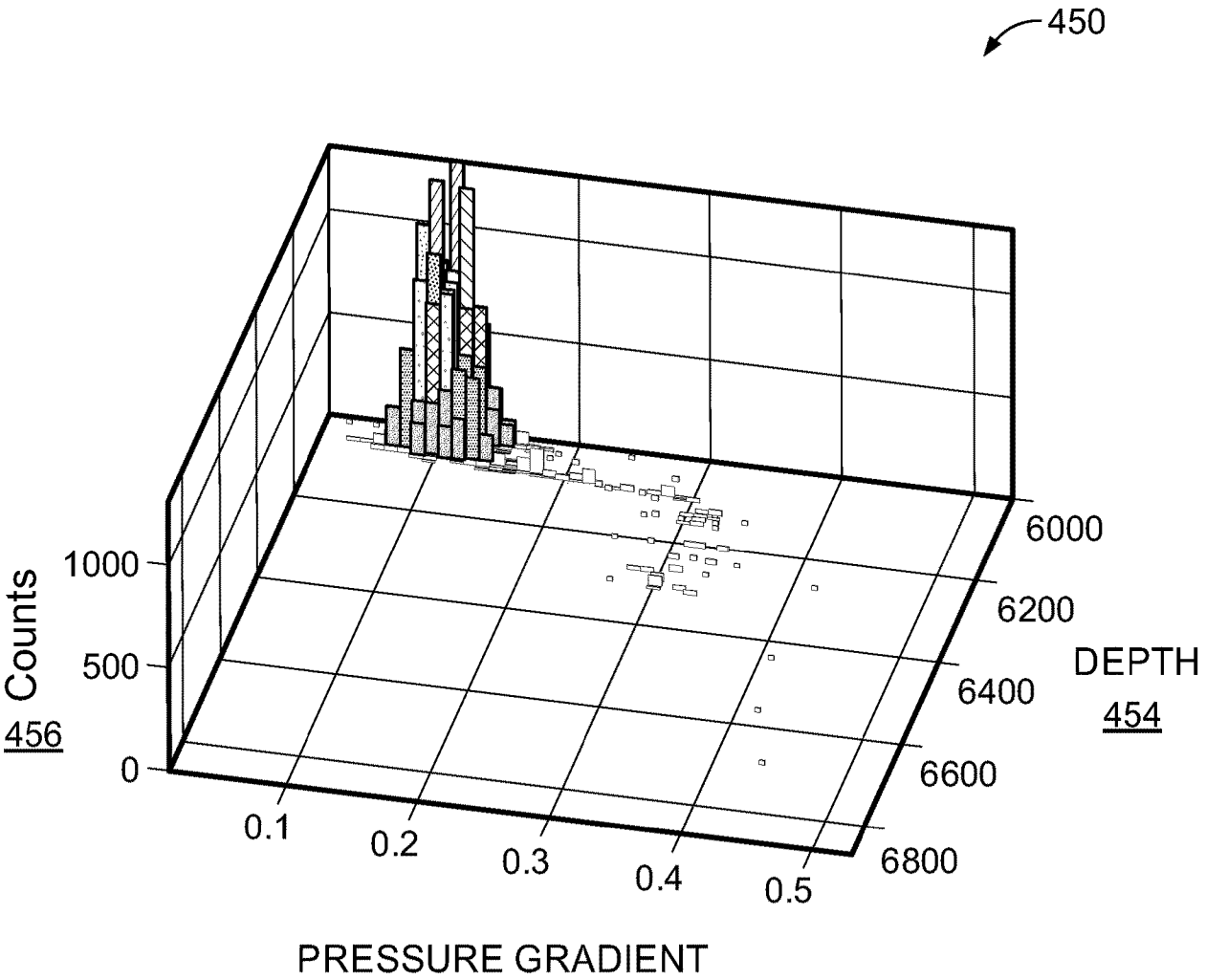

FIG. 4B illustrates an example of a histogram map 450 comprising the plurality of histograms associated with the pressure gradients in different depth windows. The histogram map 450 may have an axis 452 indicative of a pressure gradient, an axis 454 indicative of a depth, and an axis 456 indicative of the counts of the pressure gradient at the depth. The histogram map 400 takes the form of a Gaussian shape which begins around 0.1 PSI/ft (for the first 100 ft), progresses to ~0.3 PSI/ft (for ~300 ft) and finally transitions to ~0.433 PSI/ft. A histogram map associated with the intercepts plots a count of intercepts as a function of depth may look similar to the histogram map 450. The intercept may be indicative of an overburden pressure in the formation. The overburden pressure may be pressure in the formation beyond that of the fluids in the formation due to rock weight. A variation in overburden pressure over a range of depths indicates that the fluid is located in different reservoir compartments separated by an impermeable material such as rock.

At 212, a classification algorithm identifies one or more clusters in the one or more histogram maps. The clustering essentially assigns each data point (defined by two or more of a pressure, depth, pressure gradient, intercept) to one of a predefined number of centroids. An assignment of the data point to a centroid (a cluster) is chosen to minimize a preselected distance metric, such as a mean square distance from a centroid. In some examples, the data point can also include in its definition temperature, resistivity, porosity, gamma, neutron, nuclear magnetic resonance, thermal conductivity, density, acoustic spectrum, salinity, pH, quality index, standard deviation of the pressure gradient, second spatial derivative of the pressure, or any derivative, second derivative, integral, statistically derived or other functional combination of these properties which are also used in the clustering process.

In some examples, a mean pressure gradient for a cluster in the histogram map may be computed and a derivative between mean pressure gradients of two clusters taken which is indicative of a second derivative. When the second derivative varies within a threshold level, the clusters are likely the same fluid type; when it varies outside the threshold level, it is likely a new fluid. When the second derivative varies within the threshold level, the separate clusters can be combined together. Transitions in the second derivative may also be used to find transitions between clusters and likely capillary pressure zones.

Figure 5:
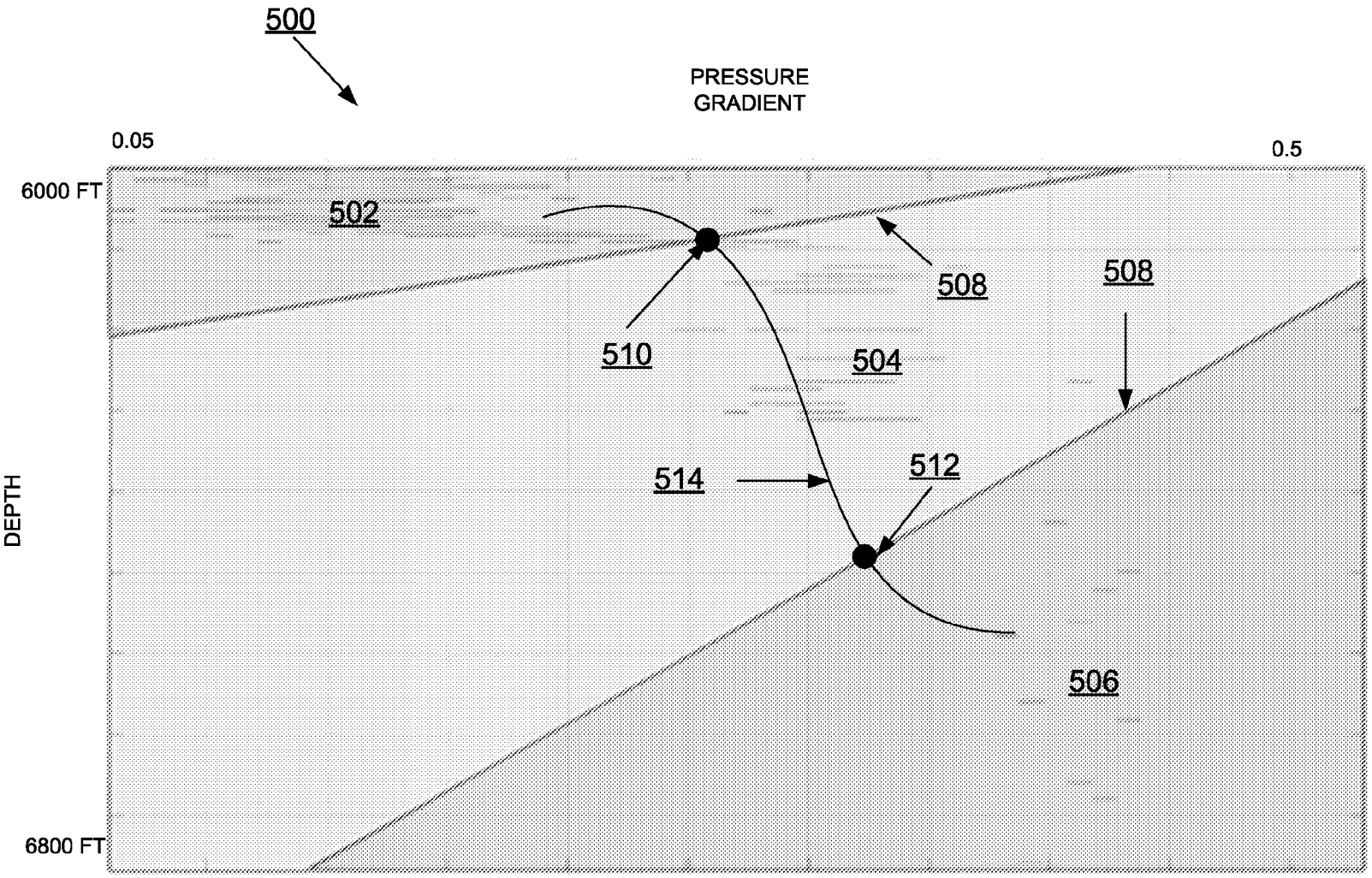
FIG. 5 show an example of clustering the pressure gradients in the histogram map.

FIG. 5 show an example 500 of clustering the pressure gradients in the histogram map into three clusters 502, 504, 506. Three clusters are shown with different shading indicating the different clusters.

At 214, a fluid type and location of fluid contact are determined based on the one or more clusters. For example, a mean and/or standard deviation of the pressure gradients in each cluster is calculated. The mean may be compared to a mean typical for a given fluid and if the mean is within a given range of the mean typical, the fluid associated with the cluster may be the type of fluid. For example, if the mean is within a range of 0.05 PSI/ft of 0.5 PSI/ft, then the fluid may be brine while if the mean is within a range of 0.1 PSI/ft of 0.09 PSI/ft, then the fluid may be gas. If mean is not indicative of any known fluid then the pressure measurements may be in error and the downhole tool can be used to perform additional pressure measurements. In some cases, the mean typical may be a mean for the given fluid with certain probability, where a probability is assigned based on a temperature, pressure, and/or salinity in the formation.

Alternatively, if the means and/or standard deviations of two clusters are statistically the same (using a statistical comparison test such as a t-test or an F-test), and/or if their means and standard deviations do not differ by a statistically significant amount, the clusters may be combined and the mean and standard deviation of the resulting cluster calculated.

A cluster 502 may indicate a fluid of a certain type and different clusters 504, 506 may indicate fluids of different type. A depth of fluid contacts 510, 512 is determined by taking a midpoint between the extremums of a boundary between clusters. As an example, the fluid contacts between the clusters shown in FIG. 3 are 6095 ft and 6375 ft. Alternatively, a curve such as a sigmoidal 514 may be fit to the data associated with the clusters and a point 510, 512 where the sigmoidal crosses from one cluster boundary 508 to the other cluster boundary 508 may be indicative of the fluid contact.

In certain cases, a cluster may identify a transition zone of two or more fluids rather than a homogenous fluid. These can be identified when the ratio of standard deviation to mean is above a statistically significant threshold, and then that cluster can be discarded as a transition zone.

The clustering algorithm may take a variety of forms such as k-means clustering, a vector quantization method. In addition to k-means clustering, other clustering analysis methods can be utilized to distinguish grouping, including: connectivity models, centroid models, distribution models, density models, graph based models, and self-organizing maps. The clusters may be also identified based on statistical (e.g., mean, standard deviation) and/or image analysis of the histograms in the histogram map and/or pattern recognition. Furthermore, while most methods useful for the technique described in this disclosure would utilize hard clustering (each element belongs to one cluster only), soft or fuzzy clustering (an element has a probability of belonging to each cluster), clustering with outliers (an element may not belong to any cluster), and overlapping clusters (an element can belong to more than more cluster) could also be used. Points within clusters can also automatically be reassigned to reflect a priori knowledge. For example, if a point lies within one identified cluster but its surrounding points all lie within a second identified cluster, that point can be reassigned to another cluster.

In some examples, the clustering algorithm may be a linear fit clustering. In the linear fit clustering, pressure gradients associated with the histogram map is fit to a line.

Figure 6:
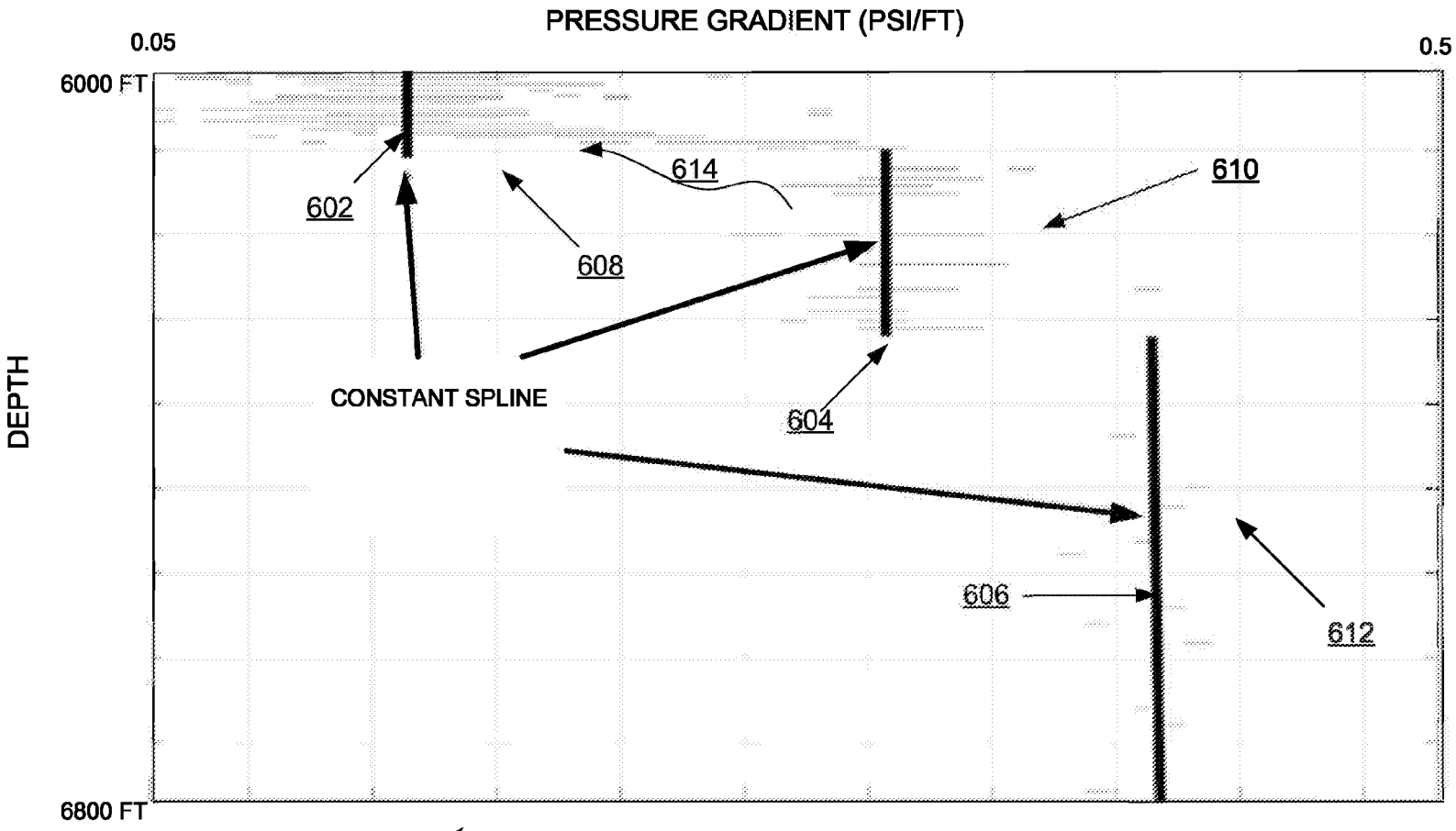
FIG. 6 illustrates application of a linear fit clustering of the pressure gradients in the histogram map.

FIG. 6 illustrates this linear fit clustering 600 for the histogram map. The pressure gradients at various depths in the histogram map are fit to a line 602, 604, 606 (also referred to as constant splines, a variation of smooth spline optimization). The line may be a vertical line that spans the pressure gradients at various depths to be fit or some other linear line. The pressure gradients at various depths that was used to define a line may be associated with the line and correspond to clusters 608, 610, 612. Statistics such as a standard deviation may be computed based on the pressure gradients at various depths corresponding to the line. Then, one or more of the pressure gradients associated with one cluster 610 may be moved to another cluster 608. This is shown as arrow 614. Then, statistics are recomputed. If a combined standard deviation (calculated, e.g., as an arithmetic sum, a geometric sum, or a sum in quadrature of the standard deviations of all clusters) for all clusters increases, then the pressure gradients which were moved are returned to its original cluster while if the combined standard deviation decreases, then the pressure gradients which is moved remains with the other cluster. This process may continue such that each pressure gradient is assigned to a respective cluster. The clusters may then be analyzed to determine fluid type and/or fluid contacts as described above.

Pressure gradients (e.g., means of pressure gradients) in adjacent clusters may also be compared to determine an arrangement of one or more reservoir compartments in which fluid is located. If the pressure gradients of each cluster do not undergo any discrete jumps at a fluid contact between clusters that is statistically significant, then the fluids associated with each cluster can be considered to be within the same reservoir compartment, taking into account that only certain fluid combinations within a reservoir compartment are also physically possible: gas with water where water is further from the surface than gas, oil with water where water is further from the surface than oil, multiple types of oil with water furthest from the surface, and gas with one or more types of oil with water where gas is at a closer to the surface and water is further from the surface. If the pressure gradients of the clusters do undergo statistically significant discrete jumps, then a permeability barrier such as rock is identified between the clusters and the clusters may be in separate reservoir compartments. In addition to examining jumps in pressure gradients, the intercepts can be used to identify fluid in separate reservoir compartments. For example, the pressure gradients for adjacent clusters might be very similar, but differing intercepts (e.g., means of intercepts) indicate that a permeability barrier such as rock separates the adjacent clusters and the adjacent clusters are in separate reservoir compartments. In some case, if certain fluid combinations are shown to be adjacent to each other which are physically not possible without a permeability barrier such as rock separating the fluids (e.g., water closer to a surface than oil even though water has a higher density than oil), but the intercept does not indicate such as a separation, then the pressure measurements may be erroneous and additional pressure measurements may need to be taken using the downhole tool.

At 216, fluid is sampled based on the determination of the fluid type and location of the fluid contact. The downhole tool may use the determination of the one or more reservoir compartments and location of fluid contacts to sample fluid at a particular depth where the fluid is a particular type. The downhole tool may additionally include a measurement device such as a spectrometer, thermal conductivity analyzer, resistometer, or the like for determining physical and chemical properties of the fluid. Additionally, or alternatively, the fluid may be directed to a sample carrier section where samples can be retained for additional analysis at the surface. The analysis may be used to make decisions about whether to drill in the formation to extract the fluid and/or a direction to drill in the formation. The baseline gradient and/or pressure gradients associated with the clusters may also be used to determine whether to and how to extract fluid from a reservoir compartment as a part of hydrocarbon extraction. The pressure gradients may also be used to determine location of disposal wells and other petroleum production activities such as reservoir completion to extract the hydrocarbon and other reservoir production decisions.

The embodiments described above are directed to use of pressure sensor data to determine the fluid type and location of fluid contacts in one or more reservoir compartments. Other sensor data can also be used in addition to or instead of the pressure sensor data to improve the methods described above. For example, formation properties such as a formation composition determined from analysis of drill shavings and/or mechanical properties as indicated by measurement logs and/or analysis of rock samples may be used instead of or in addition to pressure measurements by a downhole tool so arranged. As another example, properties such as resistivity, porosity, neutron density, temperature, salinity, optical characteristics, acoustic impedance, etc. in the formation may be measured in addition to or instead of the pressure sensor data. Although the embodiments described herein relate to pressure gradient data, the techniques may be applied to other reservoir property data including but not limited to gradients in rock properties when applied to rock property measurement data. Such examples may include but are not limited to permeability gradients, porosity gradients, shale brittleness gradients.

Further, the baseline gradient that is determined based on the formation property, such as pressure measurements as a function of depth is shown to take the form of a monotonically decreasing linear function. The baseline gradient may take other forms as well, including a piecewise monotonically decreasing linear function, a monotonically increasing linear function, a piecewise monotonically increasing linear function, a quadratic function, a function which increases and/or decreases as a function of pressure, depth, and well length among others. In some cases, a form of the baseline gradient may depend on an arrangement of the borehole, e.g., vertical or horizontal. Further, the combination of data points may be fit to functions other than a line in filtering outlier data at step 204-206 and determining the pressure gradient at step 210 of FIG. 2. The functions (e.g., modified linear, polynomial, or exponential functions) may be indicative of nonlinear gradients as appropriate in instances for fluid columns that exhibit effects of compositional grading, capillary pressure, compressibility, or other secondary phenomena to constant density. Other variations are also possible.

Figure 7:
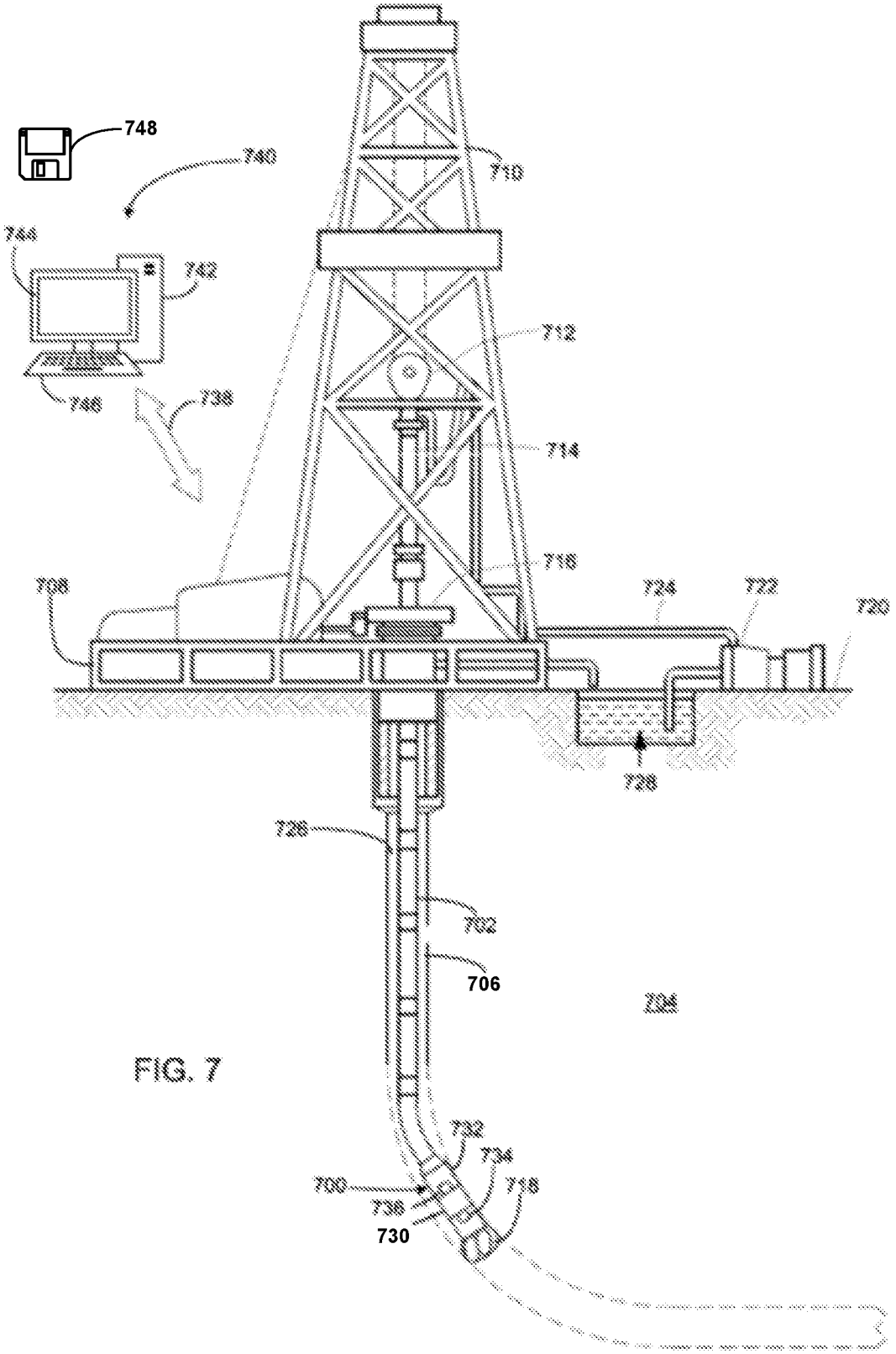
FIG. 7 is a schematic diagram of an apparatus to perform some of the operations and functions described with reference to FIGS. 1-6.

FIG. 7 is a schematic diagram of an apparatus that can be used to perform some of the operations and functions described with reference to FIGS. 1-6. The apparatus includes a sampling tool 700 disposed on a drill string 702 of a depicted well apparatus. Sampling tool 700 may be used to obtain a sample such as a sample of a reservoir fluid from a subterranean formation 704. While wellbore 706 is shown extending generally vertically into the subterranean formation 704, the principles described herein are also applicable to wellbores that extend at an angle through the subterranean formation 704, such as horizontal and slanted wellbores. For example, although FIG. 7 shows a vertical or low inclination angle well, high inclination angle or horizontal placement of the well and equipment is also possible. It should further be noted that while FIG. 7 generally depicts a land-based operation, those skilled in the art will readily recognize that the principles described herein are equally applicable to subsea operations that employ floating or sea-based platforms and rigs, without departing from the scope of the disclosure.

The well apparatus further includes a drilling platform 708 that supports a derrick 710 having a traveling block 712 for raising and lowering drill string 702. Drill string 702 may include, but is not limited to, drill pipe and coiled tubing, as generally known to those skilled in the art. A kelly 714 may support drill string 702 as it may be lowered through a rotary table 716. A drill bit 718 may be attached to the distal end of drill string 702 and may be driven either by a downhole motor and/or via rotation of drill string 702 from the surface 720. Without limitation, drill bit 718 may include, roller cone bits, PDC bits, natural diamond bits, any hole openers, reamers, coring bits, and the like. As drill bit 718 rotates, it may create and extend wellbore 706 that penetrates various subterranean formations such as 704. A pump 722 may circulate drilling fluid through a feed pipe 724 to kelly 714, downhole through interior of drill string 702, through orifices in drill bit 718, back to surface 720 via annulus 726 surrounding drill string 702, and into a retention pit 728.

Drill bit 718 may be just one piece of a downhole assembly that may include one or more drill collars 730 and sampling tool 700. One or more of drill collars 730 may form a tool body 732, which may be elongated as shown on FIG. 7. Tool body 732 may be any suitable material, including without limitation titanium, stainless steel, alloys, plastic, combinations thereof, and the like. Sampling tool 700 may further include one or more sensors 734 for measuring properties of the formation such as pressure of the formation 704, or the like. Fluid analysis module 736 may further include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, fluid analysis module 736 may include random access memory (RAM), one or more processing units, such as a central processing unit (CPU), or hardware or software control logic, ROM, and/or other types of nonvolatile memory for determining fluid type and/or fluid contacts in one or more reservoir compartments in accordance with the methods described herein.

Any suitable technique may be also used for transmitting signals from sampling tool 700 to a computing system residing on the surface 720. As illustrated, a communication link 738 (which may be wired or wireless, for example) may be provided that may transmit data from sampling tool 700 to an information handling system 740 at the surface 720. Communication link 738 may implement one or more of various known drilling telemetry techniques such as mud-pulse, acoustic, electromagnetic, optical, etc. Information handling system 740 may include a processing unit 742, a monitor 744, an input device 746 (e.g., keyboard, mouse, etc.), and/or computer media 748 (e.g., optical disks, magnetic disks) that can store code representative of the methods described herein. Information handling system 740 may act as a data acquisition system and possibly a data processing system that analyzes information from sampling tool 700. For example, information handling system 740 may process the information from sampling tool 700 to determine fluid type and/or fluid contacts in one or more reservoir compartments as described above. Information handling system 740 may also determine additional properties of the fluid sample (or reservoir fluid), such as component concentrations, pressure-volume-temperature properties (e.g., bubble point, phase envelop prediction, etc.) based on the chemical composition. This processing may occur at surface 720 in real-time. Alternatively, the processing may occur at surface 720 or another location after withdrawal of sampling tool 700 from wellbore 706.

Figure 8:
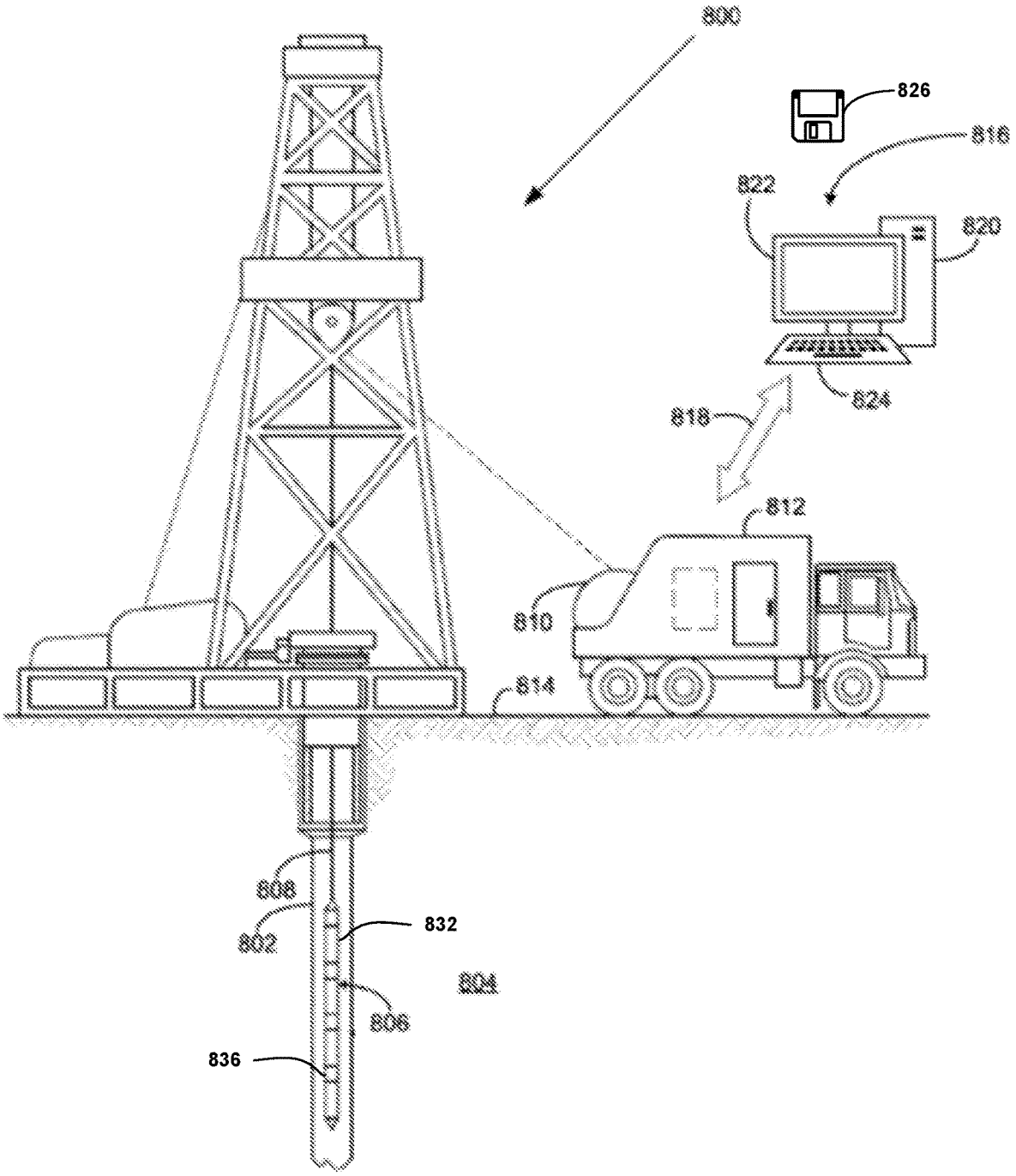
FIG. 8 is a schematic diagram of another apparatus to perform some of the operations and functions described with reference to FIGS. 1-6.

Referring now to FIG. 8, a schematic diagram is shown of an apparats 800 including a downhole sampling tool 806 on a wireline 808. As illustrated, a wellbore 802 may extend through subterranean formation 804. Downhole sampling tool 806 may be similar in configuration and operation to downhole sampling tool 700 shown on FIG. 7 except that FIG. 8 shows downhole fluid sampling tool 806 disposed on wireline 808. It should be noted that while FIG. 8 generally depicts a land-based drilling system, those skilled in the art will readily recognize that the principles described herein are equally applicable to subsea drilling operations that employ floating or sea-based platforms and rigs, without departing from the scope of the disclosure.

As illustrated, a hoist 810 may be used to run sampling tool 806 into wellbore 802. Hoist 810 may be disposed on a recovery vehicle 812. Hoist 810 may be used, for example, to raise and lower wireline 808 in wellbore 802. While hoist 810 is shown on recovery vehicle 812, it should be understood that wireline 808 may alternatively be disposed from a hoist 810 that is installed at surface 814 instead of being located on recovery vehicle 812. Downhole sampling tool 806 may be suspended in wellbore 802 on wireline 808. Other conveyance types may be used for conveying downhole sampling tool 806 into wellbore 802, including coded tubing, wired drill pipe, slickline, and downhole tractor, for example. Downhole sampling tool 806 may comprise a tool body 832, which may be elongated as shown on FIG. 8. Tool body 832 may be any suitable material, including without limitation titanium, stainless steel, alloys, plastic, combinations thereof, and the like. Downhole sampling tool 806 may further include a fluid analysis module 836 for determining fluid type and/or fluid contacts in one or more reservoir compartments in accordance with the methods described herein.

As previously described, information from sampling tool 806 such as pressure-depth data points and/or fluid type and location of fluid contacts may be transmitted to an information handling system 816, which may be located at surface 814. As illustrated, communication link 818 (which may be wired or wireless, for example) may be provided that may transmit data from downhole sampling tool 806 to an information handling system 816 at surface 814. Information handling system 816 may include a processing unit 820, a monitor 822, an input device 824 (e.g., keyboard, mouse, etc.), and/or computer media 826 (e.g., optical disks, magnetic disks) that can store code representative of the methods described herein. In addition to, or in place of processing at surface 814, processing may occur downhole (e.g., fluid analysis module 836).

Figure 9:
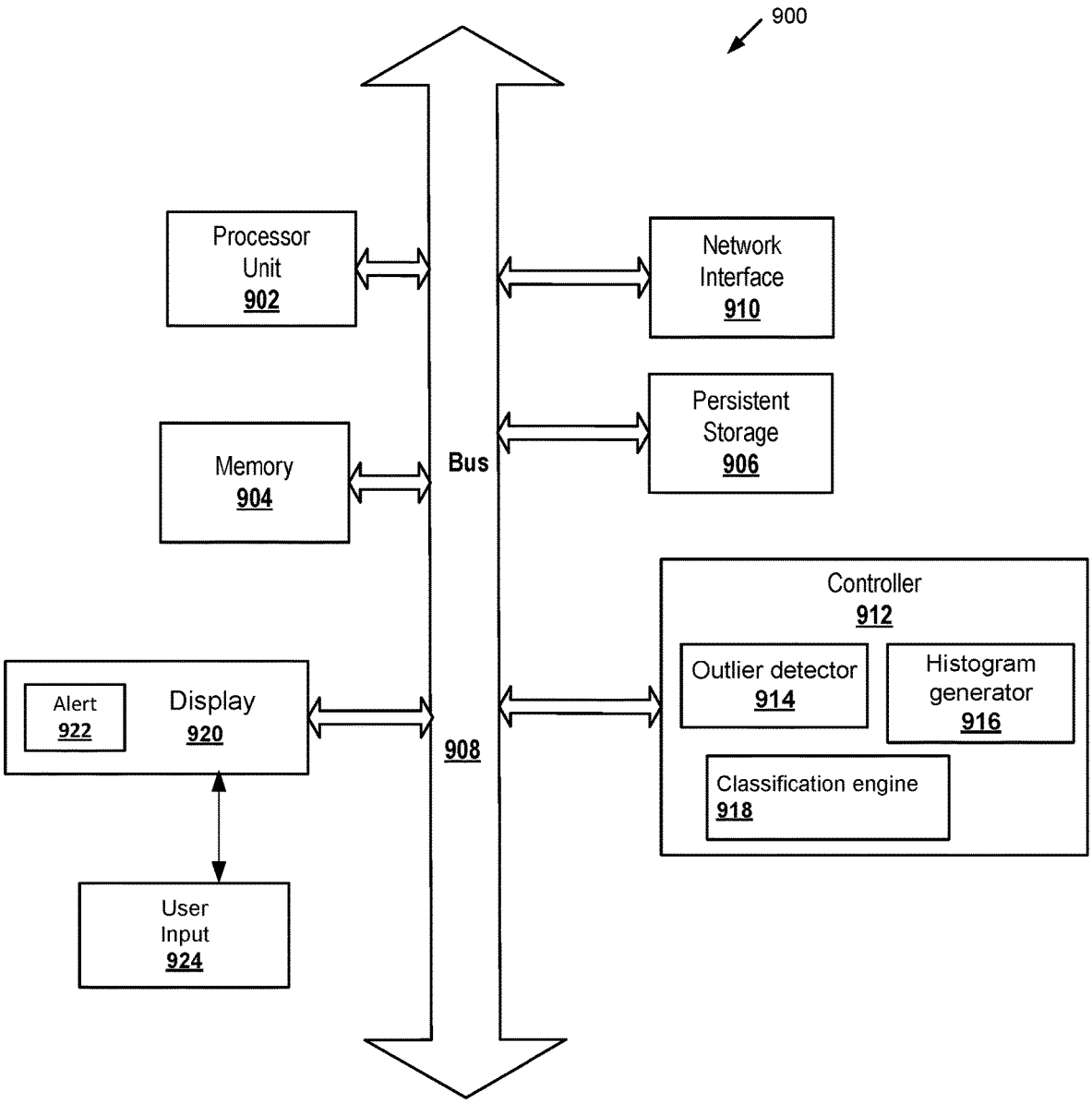
FIG. 9 is a block diagram of a system for determining a fluid type and location of fluid contacts in the one or more reservoir compartments of the geological formation using the pressure gradients.

FIG. 9 is a block diagram of system 900 (e.g., the computing system and/or drilling system) for determining fluid type and/or fluid contacts in one or more reservoir compartments in accordance with the methods described herein. The system 900 may be located at a surface of a formation and/or downhole. In the case that the system 900 is downhole, the system 900 may be rugged, unobtrusive, can withstand the temperatures and pressures in situ at the wellbore.

The system 900 includes a processor 902 (possibly including multiple processors, multiple cores, multiple nodes, and/or implementing multi-threading, etc.). The system 900 includes memory 904. The memory 904 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the above already described possible realizations of machine-readable media.

The system 900 may also include a persistent data storage 906. The persistent data storage 906 can be a hard disk drive, such as magnetic storage device. The computer device also includes a bus 908 (e.g., PCI, ISA, PCI-Express, HyperTransport® bus, InfiniBand® bus, NuBus, etc.) and a network interface 910 in communication with the sensor tool. The apparatus 900 may have a controller 912 with the outlier detection engine 914, histogram generator 916, and a classification engine 918 for determining a fluid type and/or fluid contacts in one or more reservoir compartments of the formation in accordance with the methods described above.

Further, the system 900 may further comprise a user input 924 and display 920. The user input 924 may be a keyboard, mouse, and/or touch screen, among other examples, for receiving edits of the representation of the geological formation. The display 920 may comprise a computer screen or other visual device which shows the representations of the geological surface. Additionally, the display 920 may convey alerts 922. The controller 912 may generate the alerts 922 relating to whether a fluid of a given type and/or at a given depth is located. An operator may then cause the system 900 to sample the fluid and/or geosteer a drill bit toward the fluid so as to extract the fluid from the formation.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. For example, the operations depicted in blocks 302 to 314 can be performed in parallel or concurrently. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine readable medium may be a machine readable signal medium or a machine readable storage medium. A machine readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine readable storage medium may be any non-transitory tangible medium that can contain, or store a program for use by or in connection with an instruction execution system, apparatus, or device. A machine readable storage medium is not a machine readable signal medium.

A machine readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine readable signal medium may be any machine readable medium that is not a machine readable storage medium and that can communicate, propagate, or transport a program for use by or in connection with an instruction execution system, apparatus, or device.

Program code embodied on a machine readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine readable medium that can direct a machine to function in a particular manner, such that the instructions stored in the machine readable medium produce an article of manufacture including instructions which implement the function/act specified in the flowchart and/or block diagram block or blocks.

While the aspects of the disclosure are described with reference to various implementations and exploitations, it will be understood that these aspects are illustrative and that the scope of the claims is not limited to them. In general, techniques as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

EXAMPLE EMBODIMENTS

Example embodiments include the following:

Embodiment 1

A method comprising: positioning a downhole tool in a borehole of a geological formation at a given depth; determining a formation property at the given depth; repeating the positioning and determining of the formation property at a plurality of depths in the borehole to form data points of a data set indicative of formation properties at the plurality of depths; determining first respective gradients between each combination of two or more data points in the data set; removing one or more outlier data points from the data set based on the first respective gradients to form an updated data set; determining second respective gradients between each combination of two or more data points in the updated data set; and identifying one or more properties associated with a reservoir compartment in the geological formation based on the second respective gradients.

Embodiment 2

The method of Embodiment 1, wherein removing the one or more outlier data points comprises comparing the respective first gradients to a threshold level, wherein the threshold level is indicative of a maximum or minimum pressure gradient associated with a fluid in the reservoir compartment; and removing a data point of the two or more data points associated with a highest or lowest pressure measurement from the data set.

Embodiment 3

The method of Embodiment 1 or 2, wherein identifying the one or more properties associated with the reservoir compartment comprises: determining a histogram map based on the second respective gradients, wherein the histogram map provides a count of each of the second respective gradients as a function of depth; identifying one or more clusters in the histogram map; and based on the identified one or more clusters, determining a fluid type of a fluid in the reservoir compartment.

Embodiment 4

The method of any one of Embodiments 1-3, wherein the identified one or more clusters are determined based on one or more of pressure, temperature, resistivity, porosity, gamma, neutron, nuclear magnetic resonance, thermal conductivity, density, acoustic spectrum, salinity, pH, quality index, derivative, second derivative, integral, or statistic.

Embodiment 5

The method of any one of Embodiments 1-4, wherein the second respective gradients are slopes; and wherein determining the histogram map comprises determining slopes of best fit lines for combinations of two or more data points in a depth window.

Embodiment 6

The method of any one of Embodiments 1-5, further comprising duplicating the slopes of the best fit lines based on a number of the two or more data points associated with a given best fit line and wherein the histogram map indicates a count of the duplicated slopes.

Embodiment 7

The method of any one of Embodiments 1-6, wherein determining the fluid type comprises calculating a mean pressure gradient of a given cluster and comparing the mean pressure gradient to a representative pressure gradient indicative of the fluid being the fluid type.

Embodiment 8

The method of any one of Embodiments 1-7, wherein identifying the one or more properties associated with the reservoir compartment comprises determining a fluid contact between two or more fluids in the reservoir compartment based on the identified one or more clusters.

Embodiment 9

The method of any one of Embodiments 1-8, wherein identifying the one or more clusters is based on one or more of vector quantization, smoothing spline optimization, a histogram mean and standard deviation.

Embodiment 10

The method of any one of Embodiments 1-9, further calculating a mean and standard deviation of a given cluster and merging the given cluster with another cluster based on a statistical difference between the mean and standard deviation of the given cluster and a mean and standard deviation of the other cluster.

Embodiment 11

The method of any one of Embodiments 1-10, wherein the formation property is a pressure measurement as a function of depth and the first and second respective gradients are pressure gradients.

Embodiment 12

The method of any one of Embodiments 1-11, wherein data points in the updated data set are pressure-depth data points.

Embodiment 13

The method of any one of Embodiments 1-12, further comprising completing a reservoir based on the one or more properties associated with the reservoir compartment.

Embodiment 14

The method of any one of Embodiments 1-13, wherein positioning the downhole tool in the borehole of the geological formation at the given depth comprises determining a quality index indicative of a measurement quality of the formation property at the given depth.

Embodiment 15

The method of any one of Embodiments 1-14, further comprising acquiring at least one fluid sample based on the one or more properties associated with the reservoir compartment.

Embodiment 16

One or more non-transitory machine-readable media comprising program code, the program code to: position a downhole tool in a borehole of a geological formation at a given depth; determine a formation property at the given depth; repeat the positioning and determining of the formation property at a plurality of depths in the borehole to form data points of a data set indicative of formation properties at the plurality of depths; determine first respective gradients between each combination of two or more data points in the data set; remove one or more outlier data points from the data set based on the first respective gradients to form an updated data set; determine second respective gradients between each combination of two or more data points in the updated data set; and identifying one or more properties associated with a reservoir compartment in the geological formation based on the second respective gradients.

Embodiment 17

The one or more non-transitory machine-readable media of Embodiment 16, wherein the program code to remove the one or more outlier data points further comprises program code to compare the respective first gradients to a threshold level, wherein the threshold level is indicative of a minimum or maximum pressure gradient associated with formation fluid; and removing a data point of the two or more data points associated with a highest or lowest pressure measurement from the data set.

Embodiment 18

The one or more non-transitory machine-readable media of Embodiment 16 or 17, wherein the second respective gradients are slopes, and wherein the one or more non-transitory machine-readable media further comprises program code to determine slopes of best fit lines for combinations of two or more data points in a depth window.

Embodiment 19

The one or more non-transitory machine-readable media of any one of Embodiments 16-18, wherein the program code to identify the properties associated with the reservoir compartment comprises program code to: determine a histogram map based on the respective second gradients, wherein the histogram map provides a count of each of the second respective gradients as a function of depth; identify one or more clusters in the histogram map; and based on the identified one or more clusters, determine a fluid type of a fluid in the reservoir compartment.

Embodiment 20

The one or more non-transitory machine-readable media of any one of Embodiments 16-19, wherein the program code to identify the one or more properties associated with the reservoir compartment comprises program code to determine a fluid contact between two or more fluids in the reservoir compartment based on the identified one or more clusters.

Embodiment 21

The one or more non-transitory machine-readable media of any one of Embodiments 16-20, wherein the program code to identify the one or more properties associated with the reservoir compartment comprises program code to determine a fluid contact between two or more fluids in the reservoir compartment based on the identified one or more clusters.

Embodiment 22

The one or more non-transitory machine-readable media of any one of Embodiments 16-21, wherein the formation property is a pressure measurement as a function of depth and the first and second respective gradients are pressure gradients.

Embodiment 23

A system comprising: a downhole tool positioned in a borehole of a geological formation, the downhole tool comprising a snorkel coupled to a pressure sensor for measuring a pressure along a wall of a borehole in the geological formation; a non-transitory machine readable medium having program code executable by a processor to cause the processor to: position the snorkel of the downhole tool along the wall of the borehole of the geological formation at a given depth; determine a formation property at the given depth based on a pressure measurement of the pressure sensor; repeat the positioning and determining of the formation property at a plurality of depths in the borehole to form data points of a data set indicative of a plurality of pressure measurements at the plurality of depths; determine first respective pressure gradients between each combination of two or more data points in the data set; remove one or more outlier data points from the data set based on the first respective pressure gradients to form an updated data set; fit respective lines to combinations of two or more data points in the updated data set; determine a histogram map based on second pressure gradients associated with the fitted respective lines wherein the histogram map provides a count of each of the second pressure gradients as a function of depth; identify one or more clusters in the histogram map; based on the identified one or more clusters, determine a fluid type of a fluid in the geological formation; and sample the fluid in the geological formation based on the fluid type.

Embodiment 24

A method comprising: positioning a downhole tool in a borehole of a geological formation at a given depth; determining a formation property at the given depth; repeating the positioning and determining of the formation property at a plurality of depths in the borehole to form data points of a data set indicative of formation properties at the plurality of depths where in at least one depth is based on a quality index indicative of a quality of measurement of a given formation property at the at least one depth; and determining a pressure gradient from at least part of the formation properties at the plurality of depths.

Embodiment 25

The method of Embodiment 24, wherein the quality index is based on a composite of quality indices associated with pressure measurements performed by least two probes of the downhole tool.

What is claimed is:

1. A method comprising:

positioning a downhole tool in a borehole of a geological formation at a given depth;

determining a formation property at the given depth;

repeating the positioning and determining of the formation property at a plurality of depths in the borehole to form data points of a data set indicative of formation properties at the plurality of depths;

determining first respective pressure gradients between each combination of two or more data points in the data set;

removing one or more outlier data points from the data set based on the first respective pressure gradients to form an updated data set;

determining second respective pressure gradients between each combination of two or more data points in the updated data set and identifying one or more groupings based on a count of the second respective pressure gradients as function of depth, wherein identifying the one or more groupings includes clustering each of the second respective pressure gradients into one of a number of groups, wherein an assignment of each of the second respective pressure gradients to one of the number of groups is made in order to minimize a distance metric; and identifying one or more properties associated with a reservoir compartment in the geological formation based on the one or more groupings.

2. The method of claim 1, wherein removing the one or more outlier data points comprises comparing the first respective pressure gradients to a threshold level, wherein the threshold level is indicative of a maximum or minimum pressure gradient associated with a fluid in the reservoir compartment; and removing a data point of the two or more data points associated with either a highest or a lowest pressure measurement of the two or more data point from the data set associated with the first respective pressure gradients that exceeds the threshold level.

3. The method of claim 1, wherein identifying the one or more properties associated with the reservoir compartment comprises:

determining a histogram map based on the second respective pressure gradients, wherein the histogram map provides the count of each of the second respective pressure gradients as a function of depth;

identifying the one or more groupings based on the histogram map; and based on the clustering of each of the second respective pressure gradients into one of the number of groups, determining a fluid type of a fluid in the reservoir compartment.

4. The method of claim 3, wherein the identified one or more groupings are determined based on one or more of pressure, temperature, resistivity, porosity, gamma, neutron, nuclear magnetic resonance, thermal conductivity, density, acoustic spectrum, salinity, pH, quality index, derivative, second derivative, integral, or statistic.

5. The method of claim 3, wherein determining the fluid type comprises calculating a mean pressure gradient of a given one of the one or more groupings, and comparing the mean pressure gradient to a representative pressure gradient indicative of the fluid being the fluid type.

6. The method of claim 3, wherein identifying the one or more properties associated with the reservoir compartment comprises determining a fluid contact between two or more fluids in the reservoir compartment based on the identified one or more groupings.

7. The method of claim 3, wherein identifying the one or more groupings is based on one or more of vector quantization, smoothing spline optimization, a histogram mean and standard deviation.

8. The method of claim 3, further calculating a mean and standard deviation of a given one of the one or more groupings, and merging the given one of the one or more groupings with a different one of the one or more groupings based on a statistical difference between the mean and standard deviation of the given one of the one or more groupings and a mean and standard deviation of the different one of the one or more groupings.

9. The method of claim 1, wherein the formation property is a pressure measurement as a function of depth and the first and second respective pressure gradients, and wherein data points in the updated data set are pressure-depth data points.

10. The method of claim 1, further comprising completing a reservoir based on the one or more properties associated with the reservoir compartment.

11. The method of claim 1, wherein positioning the downhole tool in the borehole of the geological formation at the given depth comprises determining a quality index indicative of a measurement quality of the formation property at the given depth.

12. The method of claim 1, further comprising acquiring at least one fluid sample based on the properties associated with the reservoir compartment.

13. The method of claim 1, further comprising:

repeating the positioning and determining of the formation property at the plurality of depths in the borehole to form data points of a data set indicative of one or more formation properties at the plurality of depths wherein at least one depth is assigned a quality index indicative of a quality of measurement of a given formation property at the at least one depth; and determining a pressure gradient from at least part of the one or more formation properties determined at the plurality of depths; and wherein the quality index is based on a composite of quality indices associated with pressure measurements performed by least two probes or snorkels of the downhole tool.

14. The method of claim 1, wherein each one of the number of groups is defined by a respective centroid.

15. One or more non-transitory machine-readable media comprising program code, the program code to:

position a downhole tool in a borehole of a geological formation at a given depth; determine a formation property at the given depth;

repeat the positioning and determining of the formation property at a plurality of depths in the borehole to form data points of a data set indicative of formation properties at the plurality of depths;

determine first respective pressure gradients between each combination of two or more data points in the data set;

remove one or more outlier data points from the data set based on the first respective pressure gradients to form an updated data set;

determine second respective pressure gradients between each combination of two or more data points in the updated data set and identify one or more groupings based on a count of the second respective pressure gradients as a function of depth, wherein identifying the one or more groupings includes clustering each of the second respective pressure gradients into one of a number of groups, wherein an assignment of each of the second respective pressure gradients to one of the number of groups is made in order to a distance metric; and identifying one or more properties associated with a reservoir compartment in the geological formation based on the one or more groupings.

16. The one or more non-transitory machine-readable media of claim 15, wherein the program code to remove the one or more outlier data points further comprises program code to compare the first respective pressure gradients to a threshold level, wherein the threshold level is indicative of a minimum or maximum pressure gradient associated with formation fluid; and removing a data point of the two or more data points associated with either a highest or a lowest pressure measurement from the data set associated with the first respective pressure gradients that exceeds the threshold level.

17. The one or more non-transitory machine-readable media of claim 15, wherein the program code to identify the properties associated with the reservoir compartment comprises program code to:

determine a histogram map based on the second respective pressure gradients, wherein the histogram map provides the count of each of the second respective pressure gradients as a function of depth;

identify the one or more groupings based on the histogram map; and based on the identified one or more groupings, determine a fluid type of a fluid in the reservoir compartment; wherein the program code to determine the fluid type comprises program code to calculate a mean pressure gradient of a given one of the one or more groupings, and comparing the mean pressure gradient to a representative pressure gradient indicative of the fluid being the fluid type; and wherein the program code to identify the one or more properties associated with the reservoir compartment comprises program code to determine a fluid contact between two or more fluids in the reservoir compartment based on the identified one or more groupings.

18. The one or more non-transitory machine-readable media of claim 15, wherein the formation property is a pressure measurement as a function of depth and the first and second respective pressure gradients.

19. The one or more non-transitory machine-readable media of claim 15, wherein each one of the number of groups is defined by a respective centroid.

20. A system comprising:

a downhole tool positioned in a borehole of a geological formation, the downhole tool comprising a snorkel coupled to a pressure sensor for measuring a pressure along a wall of a borehole in the geological formation;

a non-transitory machine readable medium having program code executable by a processor to cause the processor to:

position the snorkel of the downhole tool along the wall of the borehole of the geological formation at a given depth;

determine a formation property at the given depth based on a pressure measurement of the pressure sensor;

repeat the positioning and determining of the formation property at a plurality of depths in the borehole to form data points of a data set indicative of a plurality of pressure measurements at the plurality of depths;

determine first respective pressure gradients between each combination of two or more data points in the data set;

remove one or more outlier data points from the data set based on the first respective pressure gradients to form an updated data set;

fit respective lines to combinations of two or more data points in the updated data set;

determine a histogram map based on second pressure gradients associated with the fitted respective lines wherein the histogram map provides a count of each of the second pressure gradients as a function of depth;

identify one or more clusters in the histogram map, wherein identifying the one or more clusters includes clustering each of the second pressure gradients into one of a number of groups, wherein an assignment of each of the second pressure gradients to one of the number of groups is made in order to minimize a distance metric;

based on the identified one or more clusters, determine a fluid type of a fluid in the geological formation; and sample the fluid in the geological formation based on the fluid type.

21. The system of claim 20, wherein each one of the number of groups is defined by a respective centroid.

* * * * *